US005715894A

United States Patent [19]

Maruyama et al.

[11] Patent Number: 5,715,894

[45] Date of Patent: Feb. 10, 1998

[54] IMPACT SCREW-TIGHTENING APPARATUS

[75] Inventors: Junichi Maruyama, Yokohama; Tatsumi Nabekura, Yokosuka, both of Japan

[73] Assignee: Nissan Motor Co., Ltd., Yokohama, Japan

[21] Appl. No.: 637,087

[22] Filed: Apr. 24, 1996

[30] Foreign Application Priority Data

Apr. 25, 1995 [JP] Japan ..... 7-101458

[51] Int. Cl.[6] ..... B25B 23/14

[52] U.S. Cl. ..... 173/180; 173/181; 81/467

[58] Field of Search ..... 173/177, 176, 173/180, 181, 182, 183, 178; 81/467, 470; 73/761, 862.23, 862.24

[56] References Cited

U.S. PATENT DOCUMENTS

| | | | |
|---|---|---|---|
| 4,987,806 | 1/1991 | Lehnert | 173/180 |
| 5,154,242 | 10/1992 | Soshin et al. | 173/180 |
| 5,181,575 | 1/1993 | Maruyama et al. | 173/180 |
| 5,285,857 | 2/1994 | Shimada | 173/181 |
| 5,289,886 | 3/1994 | Shikata et al. | 173/181 |
| 5,366,026 | 11/1994 | Maruyama et al. | 173/180 |
| 5,492,185 | 2/1996 | Shoeps et al. | 173/181 |

FOREIGN PATENT DOCUMENTS 7-186060 7/1995 Japan .

*Primary Examiner*—Scott A. Smith
*Attorney, Agent, or Firm*—Foley & Lardner

[57] ABSTRACT

An impact screw-tightening apparatus is comprised of a main body and a controller. The main body includes a motor outputting pulsed drive output, a main shaft driven by the drive and connected to a screw to be tightened, and a torque detector detecting a change of torque applied to the main shaft. The controller includes a calculating section and a control section. The calculating section obtains frequency of impacts generated from a time that a bearing surface of the screw is in contact with a tightened object, on the basis of the signal from the torque detector. The control section cuts off a motive power source of the drive at a time that the frequency of the impacts becomes a predetermined value. Therefore, even if impact operation is executed prior to the contact of the bearing surface, the tightening force is accurately calculated by a rapid and brief calculation and control logic, and the dispersion of the tightening force at the cut-off time is decreased.

16 Claims, 14 Drawing Sheets

IMPACT SCREW-TIGHTENING APPARATUS

BACKGROUND OF THE INVENTION

1. Field of the Invention

The present invention relates to improvements in an impact screw-tightening apparatus such as an impact wrench and an impact nut-runner, and more particularly to improvements in a control of screw-tightening force of an impact screw-tightening apparatus.

2. Description of the Prior Art

Japanese Patent Provisional Publication No. 7-186060 discloses a typical impact wrench which includes a torque detecting section for detecting the change of a torque generated in this impact wrench and a controller. Tightening operations by this impact wrench is executed, such that a bolt is rotated for a predetermined time and then receives rotational impacts by the impact wrench, and the controller repeats the impact tightening until the tightening force becomes a target value. The controller obtains the tightening force at each impact by adding an increased amount $\delta F(i)$ at the i-th impact and the tightening force $F(i-1)$ after the $(i-1)$-th impact upon obtaining the increased amount $\delta F(i)$ as a multiple of the peak torque $T_P(i)$ in the i-th impact and a torque-tightening force conversion coefficient $C_{TF}$ which coefficient is obtained from the equation $C_{TF}(i)=C_{TF}[F(i-1)]$ and a previously obtained table indicative of a relationship between the tightening force F and a torque-tightening force conversion coefficient $C_{TF}$. That is, the tightening force after the i-th impact is derived from the following equation (A):

$$\begin{aligned} F(i) &= F(i-1)+\delta F(i) \\ &= F(i-1)+C_{TF}(i)\times T_P(i) \end{aligned} \quad \text{(A)}$$

wherein i is the number of times (frequency) of the impact applied by the impact wrench, $F(i)$ is a tightening force after the i-th impact, $F(i-1)$ is a tightening force after the (i-1)-th impact, $C_{TF}(i)$ is a torque-tightening force conversion coefficient with respect to the $F(i-1)$, and $T_P(i)$ is a peak-torque in the i-th impact.

However, this conventional impact wrench has various problems to be solved, such that due to the complexity of the calculation of the tightening force and the control logic, in case that the interval of the impacts is short the calculation cannot be executed within an interval of the impacts, and in case that the dispersion of frictional coefficients of bolts to be tightened is large the accuracy of the calculation of the tightening force is degraded to enlarge the dispersion of the final tightening force.

SUMMARY OF THE INVENTION

It is an object of the present invention to provide an improved impact screw-tightening apparatus which is free of the above-mentioned drawbacks.

A first aspect of the present invention resides in an impact screw-tightening apparatus which comprises a main body, a calculating means and a controlling means. The main body includes a drive means outputting pulsed drive output, a main shaft driven by the drive means and connected to a screw to be tightened, and a torque detecting means detecting a change of torque applied to the main shaft. The calculating means obtains frequency of impacts generated from a time that a bearing surface of the screw is in contact with a tightened object, on the basis of the signal from the torque detecting means. The controlling means cuts off a motive source of the drive means at a time that the frequency of the impacts becomes a predetermined value.

A second aspect of the present invention resides in an impact screw-tightening apparatus which comprises a main body, a calculating means and a controlling means. The main body includes a drive means which outputs pulsed drive output, a main shaft which is driven by the drive means, and connected to a screw to be tightened and a torque detecting means which detects a change of torque applied to the main shaft. The calculating means obtains a frequency of impacts generated from a time that a bearing surface of the screw is in contact with a tightened object and a peak torque by each impact on the basis of a signal of the torque detecting means. The calculating means calculates tightening force by each impact on the basis of a relationship between the tightening force and the peak torque by each impact and the frequency of the impacts generated after the bearing surface of the screw is in contact with the tightened object. The controlling means cuts off a motive source of the drive means at a time that the tightening force becomes within a predetermined range.

DETAILED DESCRIPTION OF THE INVENTION

Figure 1:
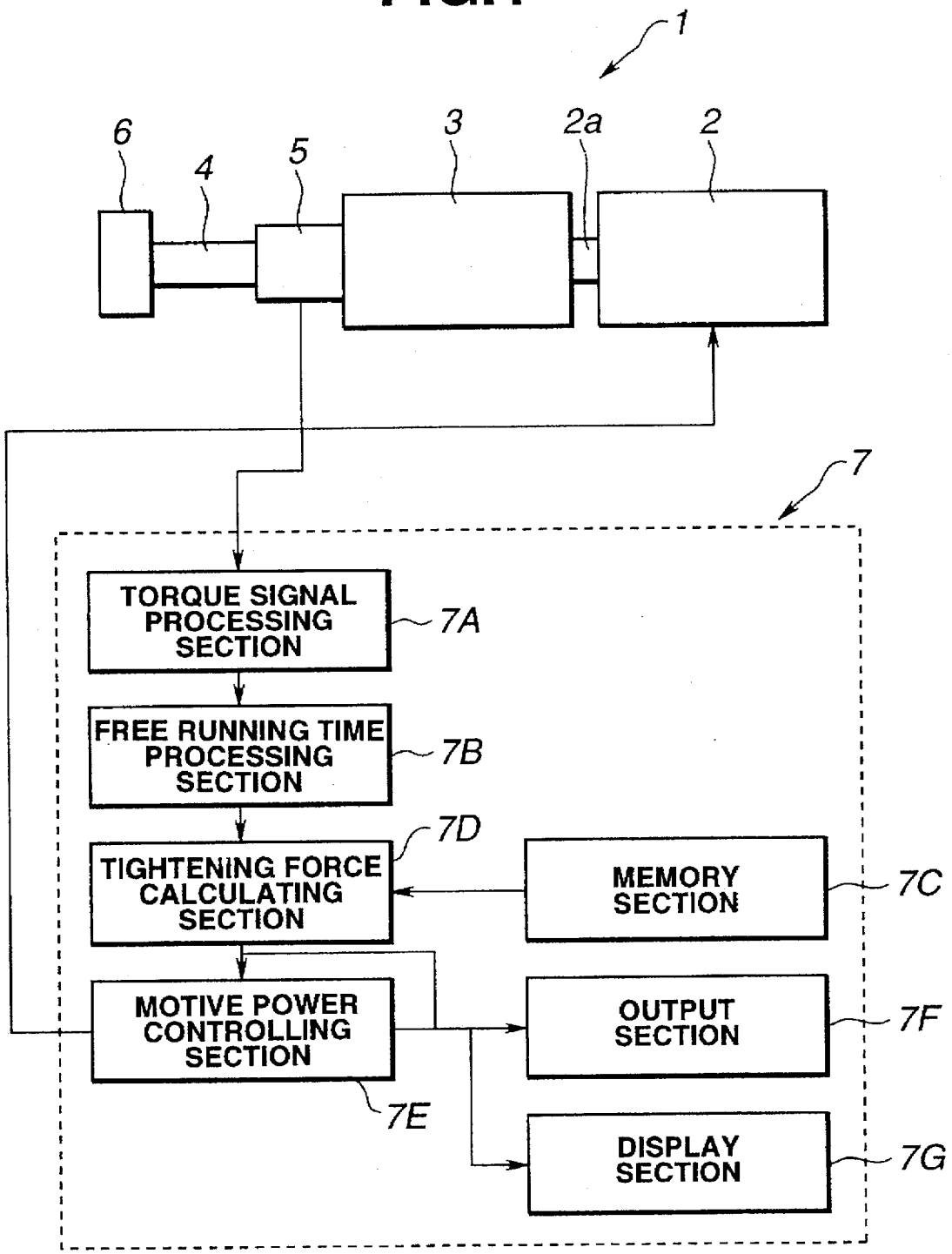
FIG. 1 is a block diagram which shows a first embodiment of an impact screw-tightening apparatus according to the present invention.

First, to facilitate the understanding of the present invention, explanations as to a change of tightening force during impact screw tightening operation will be mentioned from the viewpoint of the dynamical behavior.

When impact energy is applied from a tool to a work, a bolt or nut is rotated while receiving frictional force at its threaded surface and its bearing surface. The tightening force of the bolt is increased by the increase of extension of a neck-under portion of the bolt, wherein the torsion also increases. Therefore, the following equation is obtained.

$$U_E(i)+U_F(i)+U_T(i)=A \quad (1)$$

wherein $U_E(i)$ is tightening elastic energy at the i-th impact which energy is applied to a tightened portion in the form of tensile force of the bolt and compressive force of a tightened object, $U_F(i)$ is frictional loss energy, $U_T(i)$ is residual tortional energy, and A is supply energy of the tool and is assumed to be constant.

By defining that F(i−1) is a tightening force just prior to the i-th impact, F(i) is a tightening force at the i-th impact, and $K_E$ is a constant of the tightening elastic energy, the tightening elastic energy $U_E(i)$ is expressed as follows.

$$U_E(i)=K_E\{F(i)^2-F(i-1)^2\} \quad (2)$$

Furthermore, the constant $K_E$ of the tightening elastic energy is obtained from the following equation.

$$K_E=\frac{L_B(S_A+S_B)}{2ES_AS_B} \quad (3)$$

wherein E is a modulus of longitudinal elasticity (Young's modulus), $S_A$ is an effective cross-sectional area of the neck-under portion of the bolt, $S_B$ is an axial perpendicular cross-section area, and $L_B$ is a thickness of the tightened object when the elastic deforming portion of the tightened object is regarded as a hollow cylinder.

The frictional loss energy $U_F(i)$, which is energy consumed against the frictional force generated at a screw surface and a bearing surface when the bolt or nut is rotated by the i-th impact, is represented as follows:

$$U_F(i)=K_F\{F(i)^2-F(i-1)^2\} \quad (4)$$

wherein $K_F$ is a constant of the frictional loss energy.

The constant $K_F$ of the frictional loss energy is obtained from a proportion constant $K_{AF}$ between the rotation angle of the bolt or nut and the tightening force, the average coefficient $\mu_D$ of dynamic friction, and an average rotation radius $R_B$ of the bearing surface, as follows.

$$K_E=\frac{R_B\mu_D}{2K_{AF}} \quad (5)$$

The residual torsional energy $U_T(i)$ is a torsional elastic energy which is stored at the neck-under portion of the bolt due to the torsion generated to be balanced with the tightening force at the i-th impact. This is different from the tightening elastic energy and is not related to the tightening force. The residual torsional energy $U_T(i)$ is represented as follows:

$$U_T(i)=K_TF(i)^2 \quad (6)$$

wherein $K_T$ is a constant of the residual torsional energy.

The constant $K_T$ of the residual torsional energy is obtained from a torque coefficient K, a nominal size (basic product diameter) d, a modulus G of transverse elasticity, a thickness $L_B$ of the tightened object and the effective radius $R_C$ of the neck-under portion, as follows.

$$K_T=\frac{L_BK^2d^2}{\pi GR_C^4} \quad (7)$$

Accordingly, the following equation is obtained by substituting the equations (2), (4) and (6) into the equation (1).

$$(K_E+K_F+K_T)F(i)^2-\{(K_E+K_F)\,F(i-1)^2+A\}=0 \quad (8)$$

From the quadratic equation (8), as a solution which satisfies F(i) >0, the following solution is obtained:

$$F(i)=\sqrt{\frac{(K_E+K_F)F(i-1)^2+A}{K_E+K_F+K_T}} \quad (9)$$

Figure 4:
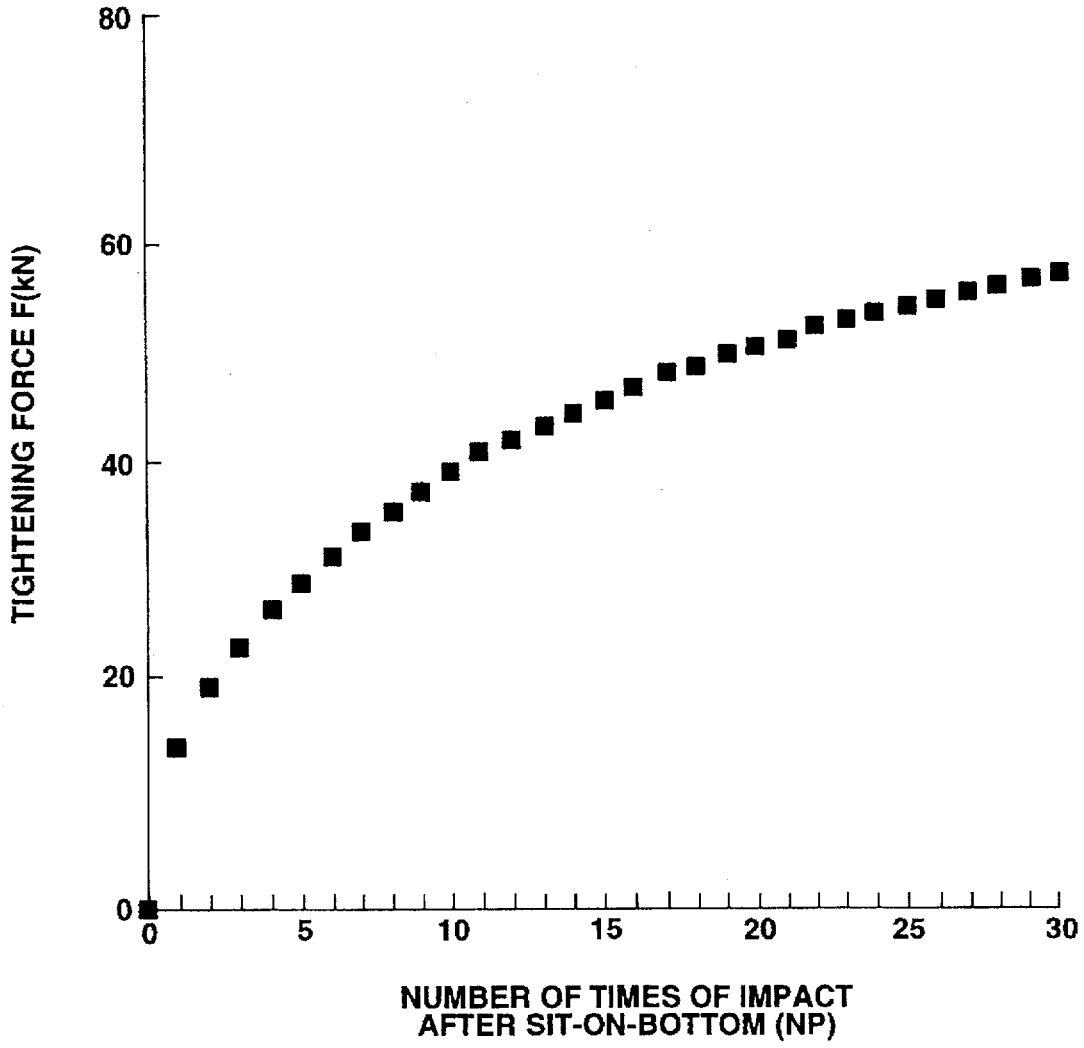
FIG. 4 is a graph which shows a relationship between the tightening force and the frequency of the impacts generated after the contact of the bearing surface of a screw and which is stored in a memory section in the form of a table.

From this solution, when it may regard that the supply energy A of the tool, the tightening elastic energy $K_E$, the frictional loss energy constant $K_F$ and the residual torsion energy constant $K_T$ are constant in the impact tightening, that is, when the dispersion of the friction coefficients of the screw surfaces and the bearing surfaces are kept small, the tightening force F(i) after the i-th impact is determined by the frequency i of the impacts as shown in FIG. 4.

When the dispersion of the friction coefficients of the screw surface and the bearing surface are large, the dispersions of the frictional loss energy constant $K_F$ and the residual torsion energy constant $K_T$ also become large. Therefore, it is necessary to estimate the tightening upon taking the influence of these dispersions into consideration.

The frictional loss energy constant $K_F$ is represented from the equation (5) as follows:

$$K_F=K_{F0}(1+x) \quad (10)$$

wherein $K_{F0}$ is a standard value of the frictional loss energy constant $K_F$, and x is the offset ratio of the frictional loss energy constant $K_F$.

Since the torque coefficient K is proportional to the frictional coefficient if a standard value of the residual torsional energy constant $K_T$ is $K_{T0}$, the following equation is derived:

$$K=K_0(1+x) \quad (11)$$

$$K_T=K_{T0}(1+x)^2 \quad (12)$$

Accordingly, by substituting the equations (10) and (11) into the equation (9), the tightening force F(i) is represented as follows:

$$F(i)=\sqrt{\frac{\{K_E+K_{F0}(1+x)\}F(i-1)^2+A}{K_E+K_{F0}(1+x)+K_{T0}(1+x)^2}} \quad (13)$$

On the other hand, since a peak torque $T_P(i)$ due to the impact is a maximum static friction torque just before the start of the rotation of the bolt or nut, the peak torque $T_P(i)$ is represented as follows:

$$T_P(i)=KdF(i-1)=K_0(1+x)dF(i-1) \quad (14)$$

These equations indicate that the tightening force F(i) and the peak torque $T_P(i)$ are both determined by the frequency (number of times) i of the impacts and the offset ratio x of the friction coefficient. That is, by previously preparing a table representing the relationship between the tightening force F(i) and the peak torque $T_P(i)$ through parameters i and x, it becomes possible to represent the tightening force F(i) by the frequency i and the peak torque $T_P(i)$ which are detectable values.

Hereinafter, the present invention will be discussed with reference to the drawings.

Figure 2:
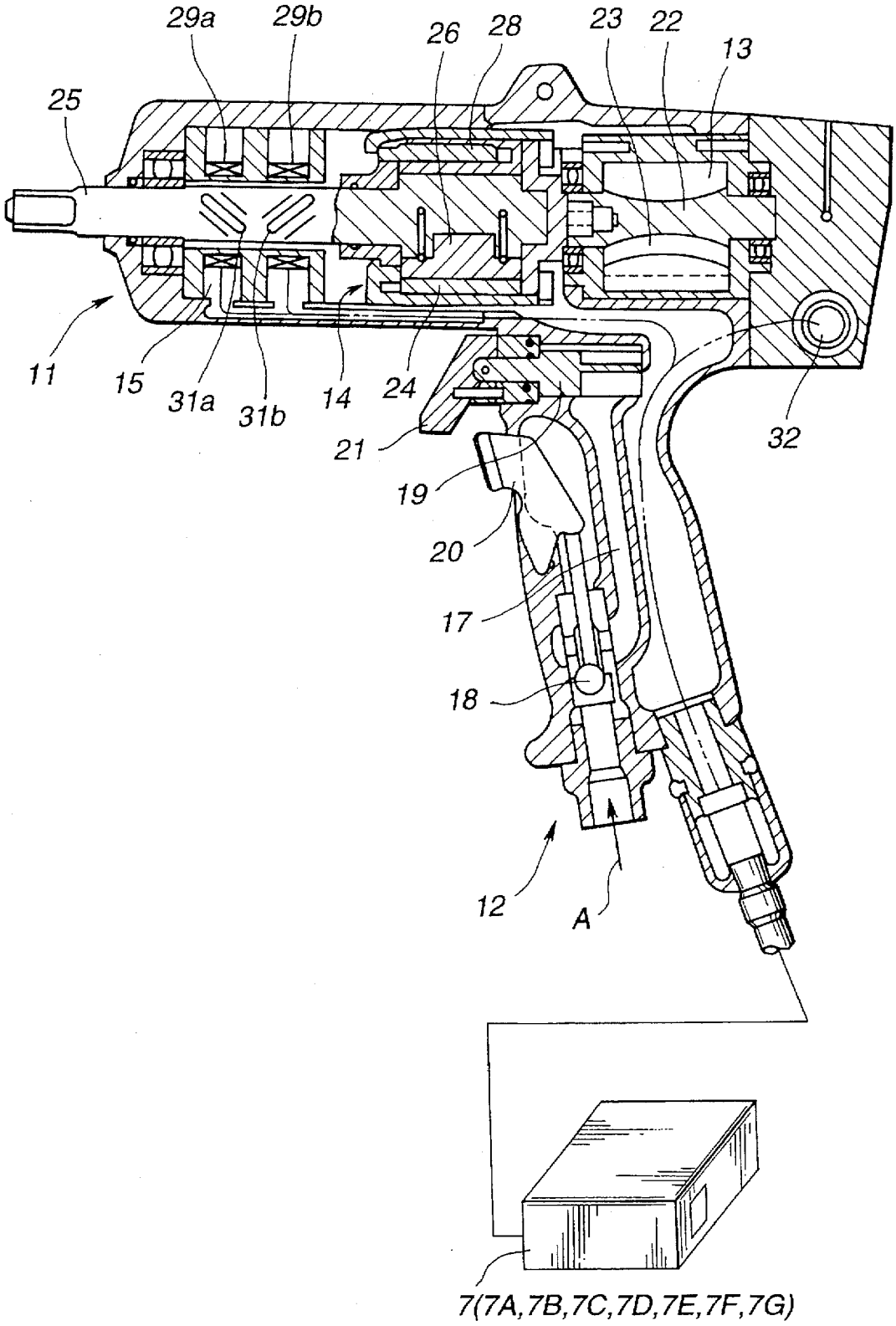
FIG. 2 is a cross-sectional view of a main body of the impact screw tightening apparatus of the first embodiment.
Figure 3:
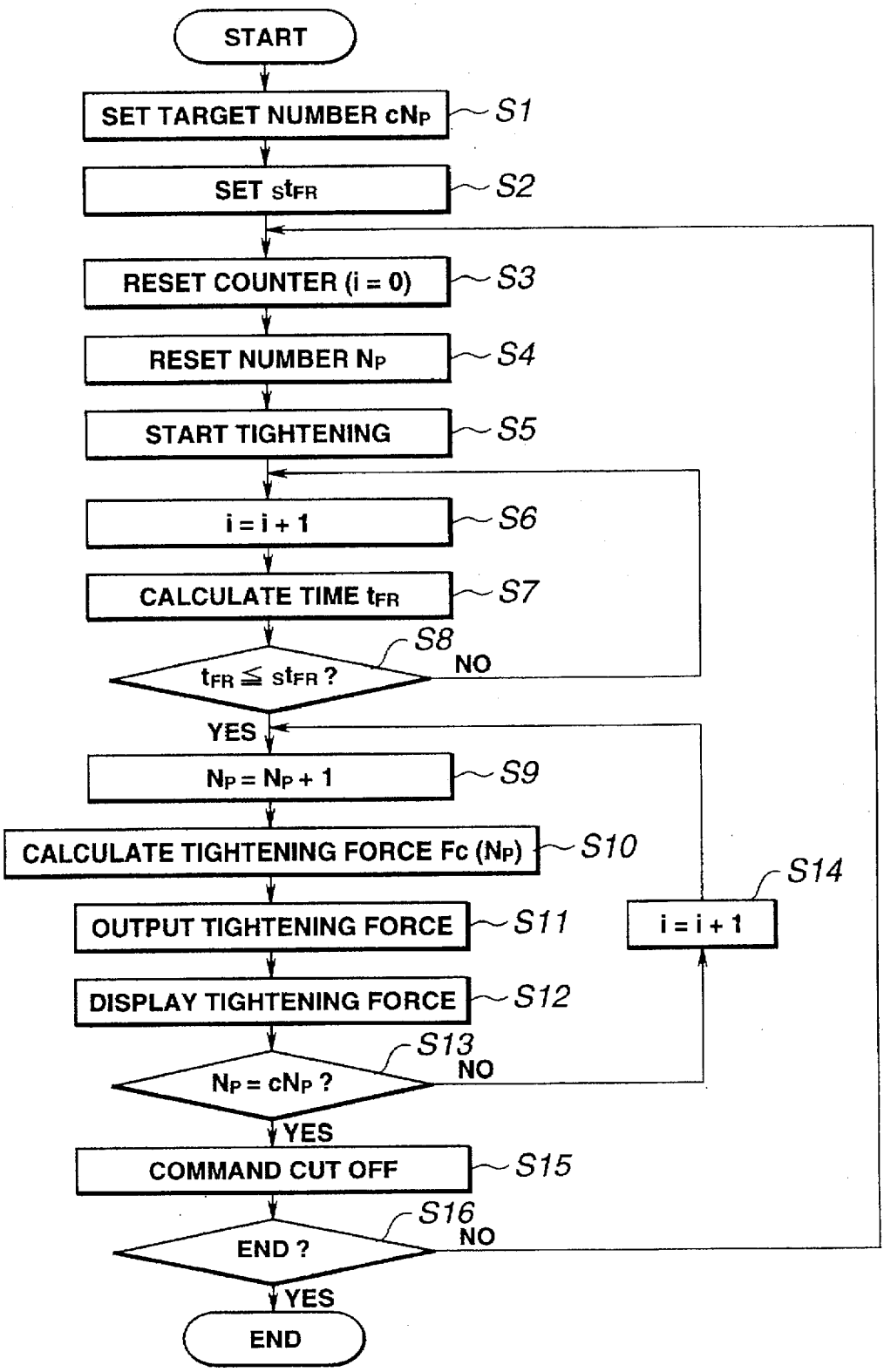
FIG. 3 is a flowchart which shows calculating operations in the first embodiment.

Referring to FIGS. 1 to 3, there is shown a first embodiment of an impact screw-tightening apparatus according to the present invention. The first embodiment is arranged to detect frequency of impacts generated after the decision that a bearing surface of a bolt or screw is in contact with a tightened object, to calculate tightening force at each impact on the basis of a previously stored relationship between the tightening force and the frequency of the impacts generated after the contact of the bearing surface of the bolt or screw with the tightened object, to output and display the calculated result, and to cut off the power source of the drive means at a time that the frequency of the generated impacts becomes a predetermined value.

FIG. 1 shows a schematic construction of an impact screw-tightening apparatus of a first embodiment according to the present invention. In FIG. 1, the main body 1 of the impact screw-tightening apparatus is constituted by a motor 2, an impact torque generator 3 which is connected to an output shaft 2*a* of the motor 2 and converts the continuous rotational force of the motor 2 to impact torque, a torque detector 5 which detects a torque applied to an output shaft (a main shaft) 4 of the impact torque generator 3, and a tightening socket (a connecting portion) 6 installed to the main shaft 4. The motor 2 may not be limited to an electric motor or an air motor and may be a motor of the other type which can generate drive force like as the electric motor and the air motor. Further, by properly selecting one of the tightening sockets, the impact screw tightening apparatus can be used as a wrench, a nut-runner and so on.

The main body 1 is connected with a controller 7 which is constituted by a torque signal processing section 7A which converts a signal from the torque detector 5 into a torque signal, a free running time processing section 7B, a tightening force data storing section 7C, a tightening force calculating section 7D, a motive power controlling section 7E, an output section 7F and a display section 7G.

FIG. 2 shows a particular construction of the impact screw-tightening apparatus of the first embodiment wherein compressed air is used as motive power source. In FIG. 2, 11 denotes a main body corresponding to the main body 1 of FIG. 1. Disposed in the main body 11 are an air supply section 12 and an air motor section 13 corresponding to the motor 2 of FIG. 1, a hydraulic pulse generating section 14 corresponding to the impact torque generator 3 of FIG. 1, and a torque detecting section 15 corresponding to the torque detector 5 of FIG. 1.

In the air supply section 12, an air passage 17 communicated with the air motor section 13 is formed. A main valve 18 and a selector valve 19 are disposed in the air passage 17 in the order of this description. The main valve 18 is opened by triggering a valve operation lever 20. The selector valve 19 is arranged to be opened by turning a rotation selector lever 21 to a predetermined position. The air motor section 13 is provided with a rotation drive shaft 22 disposed in an eccentric cylinder. The rotation drive shaft 22 is rotated by compressed air applied to a vane 23 thereof. The hydraulic pulse generator 14 is constituted by a main shaft 25 corresponding to the main shaft 4 of FIG. 1 and a driving blade 26 installed to the main shaft 25. The main shaft 25 is disposed in a liner case 24 which is directly connected with the rotation drive shaft 22 of the air motor section 12 and which is filled with hydraulic fluid.

The main shaft 25 is rotated with the rotation drive shaft 22 of the air motor section 13 by the resistance of inner surfaces of the liner case 24 and the driving blade 26 when the load to the main shaft 25 is smaller than a predetermined value. When the load thereof becomes larger than the predetermined value, the main shaft 25 is rotated by the force of impacts owing to the deviation of the hydraulic power applied to the inner surface of the driving blade 26 through a relief valve 28. A tip end portion of the main shaft 25 is formed into a shape to which a socket is connected so as to be connected to a screw. By properly selecting one of the tip end portions to fit with a desired screw, it becomes possible to tighten various screws and bolts.

The torque detecting section 15 corresponding to the torque detector 5 of FIG. 1 is constituted by a pair of coils 29*a* and 29*b* and is disposed around the main shaft 25. The main shaft 25 is made from a material which performs a magneto-strictive effect and to which a right and left pair of groove trains 31*a* and 31*b* having different spiral angles are installed. The groove trains 31*a* and 31*b* are disposed opposite to the coils 29*a* and 29*b* so that the coils 29*a* and 29*b* can detect the torque applied to the main shaft 25. A cut off mechanism of compressed air is constituted such that the shut off valve 32 for supplying and shutting-off the compressed air to the air motor section 13 is disposed in the air passage 17 communicating the selector valve 19 and the air motor section 13. The controller 7 shown in FIG. 2 is electrically connected with the main body 11 and is constituted by the torque signal processing section 7A, the free running time processing section 7B, the tightening force data storing section (memory section) 7C, a tightening force calculating section 7D, the motive power controlling section 7E, an output section 7F and a display section 7G as same as those of the controller 7 in FIG. 1.

FIG. 4 shows an example of a table which shows a relationship between tightening force F and frequency Np of the impacts generated after the bearing surface of the screw is contacted with the object surface. The concrete values in this relationship is variously changed according to the combination of screws or bolts, tightened objects and impact wrenches. Therefore, this type of table is prepared for each of the combinations. The tightening force calculating section 7D calculates a tightening force according to this table.

Next, the operation of the first embodiment will be discussed with reference to the flowchart of FIG. 3.

By triggering the valve operation lever 20, compressed air is supplied from the air supply section 12 to the air motor section 13 through a shut off valve 32. Then, the rotational force of the rotation drive shaft 22 is converted into impacts functioning as rotational force in the hydraulic pressure pulse generating section 14 and is transmitted to the main shaft 25 to execute the impact screw-tightening operation.

At a step S1, the controller 7 sets a predetermined frequency (the number of times) of impacts to be generated, that is, a target frequency ${}_{C}N_{P}$ of the impacts to be generated.

At a step S2, the controller 7 sets a free running time threshold ${}_{S}t_{FR}$ corresponding to a threshold value for deciding that the bearing surface of the bolt is contacted to the tightened object.

At a step S3, a counter for counting the frequency (the number of times) i of impacts is reset (i=0).

At a step S4, the frequency $N_P$ of the impacts generated after a time that the bearing surface of the bolt is contacted to the bearing surface is reset ($N_P$=0).

At a step S5, the screw (bolt) tightening is started.

In a loop from a step S6 to a step S8, it is decided by each impact as to whether the bearing surface of the bolt is in contact with the tightened object or not until the bearing surface becomes in contact with the tightened object. At the step S6, the frequency i of impacts is incremented by 1 (i=i+1). At a step S7, the free running time $t_{FR}$ is obtained on the basis of the signal from the torque signal processing section 7A.

At a step S8, it is decided as to whether or not the free running time $t_{FR}$ is smaller than or equal to the free running time threshold $_{S}t_{FR}$. When the decision at the step S8 is NO, the routine returns to the step S6. When the decision at the step S8 is YES, the routine proceeds to a next loop from a step S9 to S14 wherein the calculation of the tightening force and the output and display of the calculated tightening force are executed.

At the step S9, the frequency $N_P$ of the impacts generated after the head contact is incremented by 1 ($N_P$=$N_P$+1).

At a step S10, the tightening force $F_C(N_P)$ is calculated on the basis of the table stored in the tightening force data storing section 7C.

At a step S11, the controller 7 executes to output the calculated tightening force $F_C(N_P)$. At a step S12, the controller 7 executes to display the calculated tightening force $F_C(N_P)$. With this execution, the calculated tightening force $F_C(N_P)$ is outputted from the output section 7F and displayed at the display section 7G.

At a step S13, the controller 7 decides as to whether the frequency $N_P$ of the impacts generated after the contact of the bearing surface is equal to the target frequency $C^NP$ of the impacts to be generated or not. When the decision at the step S13 is NO, the routine proceeds to a step S14 wherein the frequency i of the impacts are incremented by 1 (i=i+1). Following this, the routine returns to the step S9 and repeats the loop from the step S9 to the step S13. When the decision at the step S13 is YES, the routine proceeds to the step S15 wherein the controller 7 outputs a command for cutting off the cut off valve to stop the supply of the compressed air to the impact screw-tightening apparatus.

At a step S16, the controller 7 decides as to whether the routine is ended or not. When the decision at the step S16 is YES, the routine goes to END. When the decision at the step S16 is NO, the routine returns to the step S3 to execute next screw-tightening operation.

Figure 5:
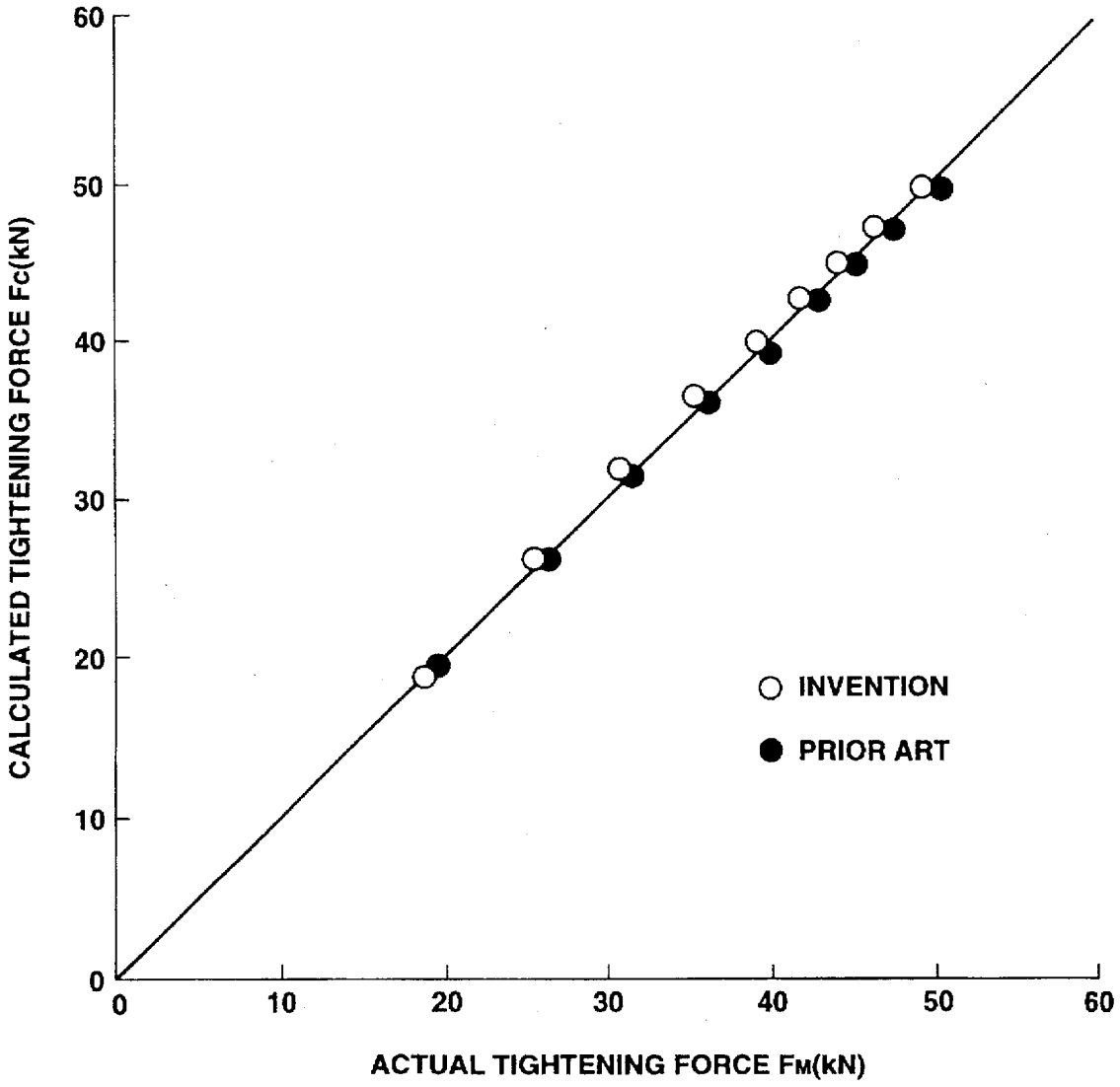
FIG. 5 is a graph which shows characteristics of the calculated tightening force with respect to the measured tightening force.

FIG. 5 shows a comparison view where the calculated tightening forces according to this invention and the conventional method are compared with actually measured tightening forces. In FIG. 5, ○ marks denote the characteristics of the present invention, and • marks denote the characteristic of the conventional art. This data was obtained as to a case that a tightened object having 40 mm distance between bearing surfaces was tightened by a bolt and nut of size M12. The calculated tightening force F(i) of the present invention was obtained on the basis of the table of FIG. 4 (a table as to a relationship between the tightening force F and the frequency $N_p$ of the impacts generated after the contact of the bearing surface). On the other hand, the calculated tightening force of the conventional art was obtained on the basis of a table showing a reliability of the torque-tightening force conversion coefficient $C_{TF}$ to the tightening force.

Figure 6:
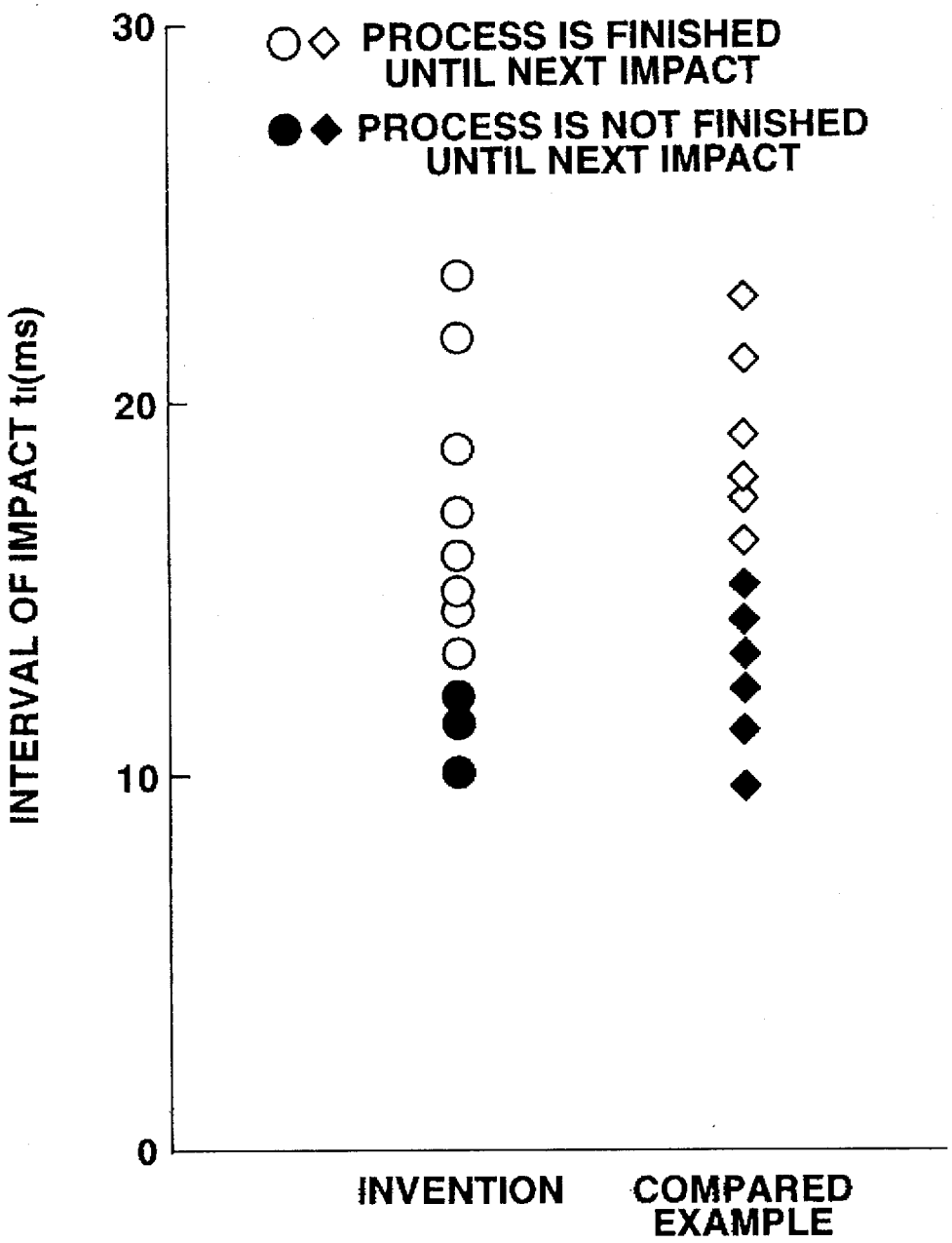
FIG. 6 is a graph which shows a comparison between the calculation speeds of the present invention and the prior art relative to the impact interval.

FIG. 6 shows a comparison view where the calculation speeds of the present invention and the conventional art are compared. In FIG. 6, ○ marks and • marks denote the characteristics of the present invention, and ◇ marks and ♦ marks denote the characteristics of the conventional art. The white marks (◇, ○) of these marks denote that the calculation has finished until next impacting in case that the impact generation interval is changed. On the other hand, the black marks (●,♦) denote that the calculation has not finished until next impacting.

As is clear from the characteristics shown in FIGS. 5 and 6, the accuracy of the calculated tightening force of the present invention is generally the same as that of the conventional art, and the calculation speed of the present invention is higher than that of the conventional art.

With the first embodiment of the present invention, the frequency of the impacts is detected after the decision that the bearing surface of the bolt and nut is in contact with the tightened object from the detection result of torque detecting means, and the tightening force at each impact is calculated on the basis of the previously obtained relationship between the tightening force and the frequency of the impact generated after the contact of the bearing surface of the bolt and nut to the tightened object. Then, the calculated result is outputted and displayed, and the power source of the drive means is cut off at a time that the frequency of the impacts becomes a predetermined value. Therefore, even if the impact tightening operation is executed prior to the contact of the bearing surface, for example, in case that a self-locking nut is applied to the tightening, the tightened force is accurately calculated by means of a rapid and brief calculation and control logic, and the dispersion of the tightening force at the cut-off time is decreased. In addition, it is possible to monitor the change of the tightening force during the tightening operation.

Figure 7:
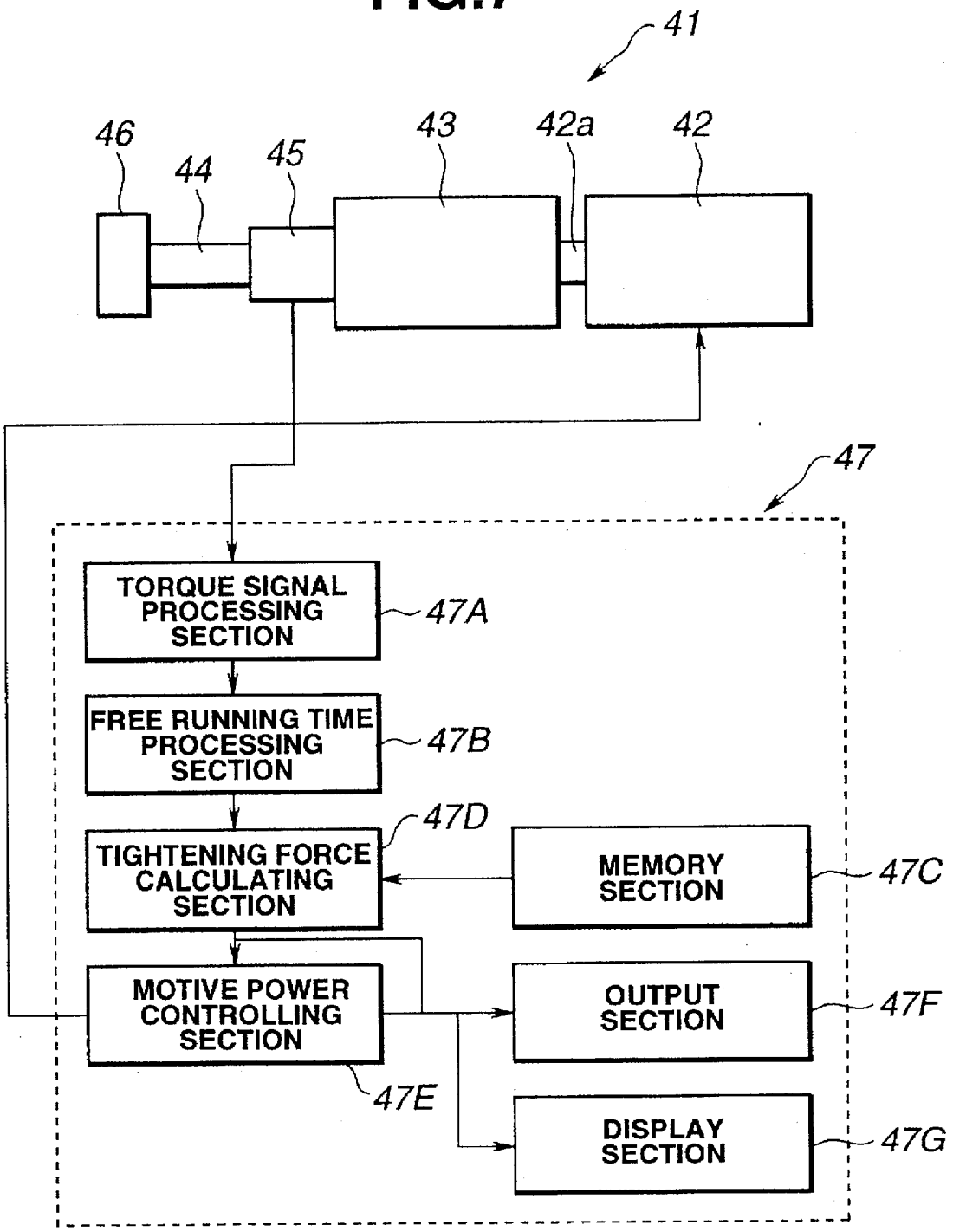
FIG. 7 is a block diagram which shows a second embodiment of the impact screw tightening apparatus according to the present invention.
Figure 8:
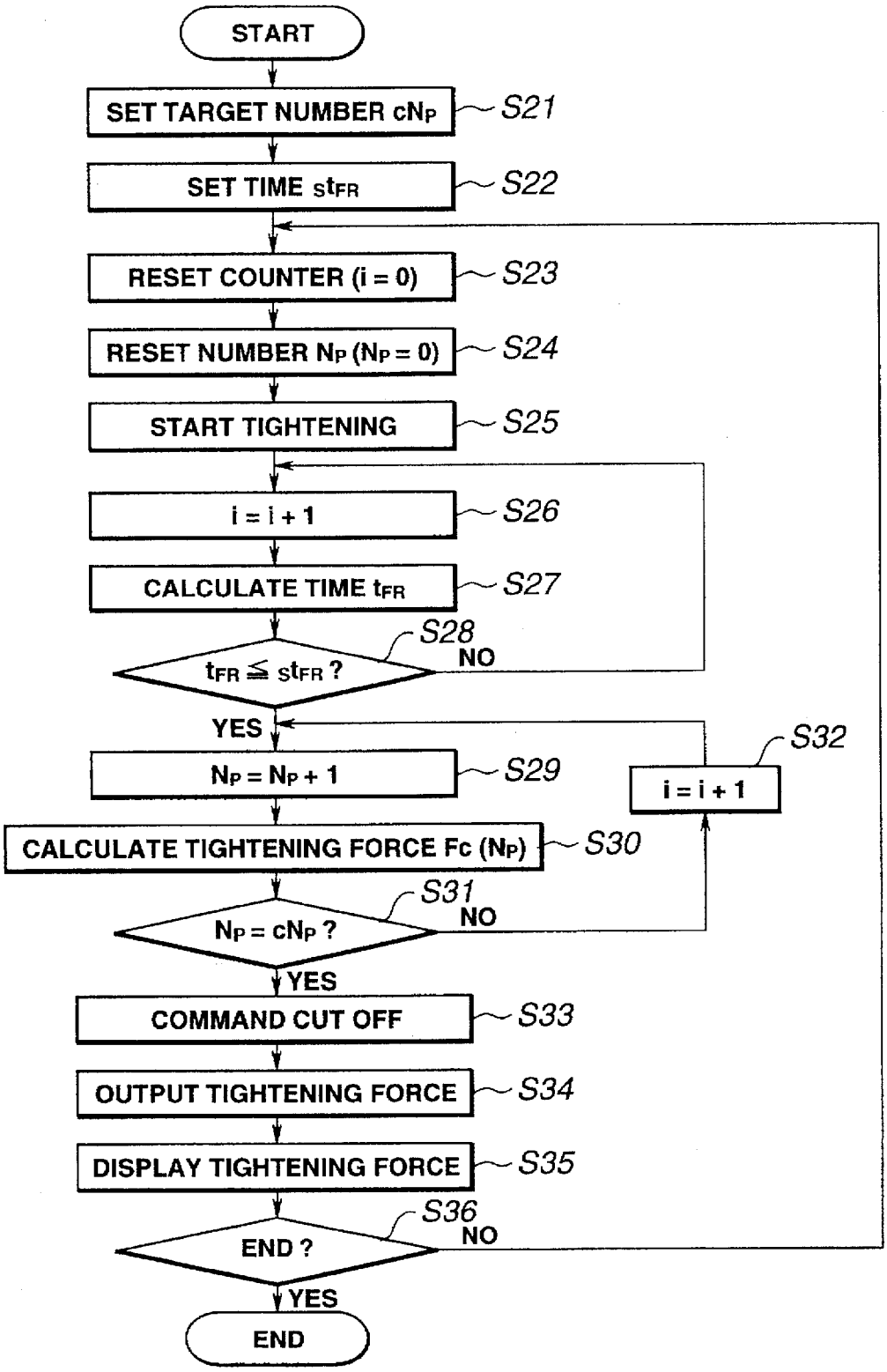
FIG. 8 is a flowchart which shows calculating operations in the second embodiment.

Referring to FIGS. 7 and 8, there is shown a second embodiment of the impact type screw tightening apparatus according to the present invention. The second embodiment is arranged to detect the frequency of the impacts generated after the decision that the bolt and screw is in contact with the tightened surface, to calculate tightening force at each impact on the basis of the previously obtained relationship between tightening force and the frequency of the impact generated after the contact of the bearing surface of the bolt and nut with the tightened object, further to cut off the power source of the drive means at a time that the frequency of the impacts becomes a predetermined value, and to output and display the tightening force at the cut off time.

As shown in FIG. 7, a main body 41 of the impact screw-tightening apparatus is constituted by a motor 42, an impact torque generator 43, a main shaft 44, a torque detector 45 and a tightening socket 46, as is similar to the first embodiment.

The main body 41 of the impact screw-tightening apparatus is connected with a controller 47. The controller 47 is constituted by a torque signal processing section 47A, a free running time processing section 47B, a tightening force data storing section (memory section) 47C, and a motive power controlling section 47E as is similar to the first embodiment, and a tightening force calculating section 47D, an output section 47F and a display section 47G which are slightly different from those of the first embodiment.

Next, the operation of the second embodiment will be discussed with reference to a flowchart of FIG. 8.

At a step S21, the controller 47 sets a target frequency $C^NP$ of the impacts.

At a step S22, the controller 47 sets a free running time threshold $_{S}t_{FR}$ corresponding to a threshold value for deciding that the bearing surface of the bolt and nut is in contact with the tightened object. The threshold value has been previously obtained by experiments.

At a step S23, a counter for counting the frequency of impacts is reset (i=0).

At a step S24, the controller 47 resets the frequency $N_P$ of the impacts generated after the contact of the bearing surface of the bolt and nut with the tightened object ($N_P$=0).

At a step S25, the screw (bolt) tightening is started.

In a routine from a step S26 to a step S36, the execution at a step S27 corresponds to the processing in the free running time processing section 47B, the execution in steps S31 and S33 corresponds to the processing in the motive power controlling section 47E, and the other steps, that is, the steps S26, S28, S29, S30, S32, S34, S35 and S36 correspond to the processing in the tightening force calculating section 47D.

In the loop from the step S26 to the step S28, it is decided by each impact as to whether the bearing surface of the bolt and nut is in contact with the tightened object or not until the bearing surface of the bolt becomes in contact with the tightened object. At the step S26, the times i of impacts is incremented by 1 (i=i+1). At a step S27, the free running time $t_{FR}$ is obtained on the basis of the signal from the torque signal processing section 47A.

At a step S28, it is decided as to whether or not the free running time $t_{FR}$ is smaller than or equal to the free running time threshold $_{S}t_{FR}$. When the decision at the step S28 is NO, the routine returns to the step S26. When the decision at the step S28 is YES, the routine proceeds to a next loop from a step S29 to the step S31 wherein the calculation of the tightening force by each impact is executed.

At the step S29, the impact frequency $N_P$ generated after the contact of the bearing surface is incremented by 1 ($N_p$=$N_p$+1). At a step S30, the tightening force $F_C(N_P)$ is calculated on the basis of the table stored in the tightening force data storing section 47C.

At a step S31, it is decided as to whether the impact frequency $N_P$ generated after the contact of the bearing surface is equal to the target frequency $C^NP$ or not. When the decision at the step S31 is NO, the routine proceeds to a step S32 wherein the frequency i of the impacts are incremented by 1 (i=i+1). Following this, the routine returns to the step S29 and repeats this loop from the step S29 to the step S31. When the decision at the step S31 is YES, the routine proceeds to the step S33 wherein the controller 47 outputs a command for cutting off the cut off valve to stop the supply of the compressed air to the impact screw-tightening apparatus.

At a step S34, the controller 47 executes to output the calculated tightening force $F_C(N_P)$. At a step S35, the controller 47 executes to display the calculated tightening force $F_C(N_P)$. With this executions, the calculated tightening force at the cut-off time is outputted from the output section 47F and displayed at the display section 47G.

At a step S36, the controller 47 decides as to whether the routine is ended or not. When the decision at the step S36 is YES, the routine goes to END. When the decision at the step S36 is NO, the routine returns to the step S23 to execute next screw-tightening operation.

The second embodiment performed to ensure the result as same as that of the first embodiment shown in FIGS. 5 and 6.

With the thus arranged second embodiment according to the present invention, the frequency of the impacts is detected after the decision that the bearing surface of the bolt or screw is in contact with the tightened object according to the detection result of the torque detecting means, and the tightening force by each impact is calculated on the basis of the previously obtained relationship between the tightening force and the frequency of the impact generated after the bearing surface of the bolt or screw is in contact with the tightened object. Then, the power source of the drive means is cut off at a time that the generated frequency of the impacts becomes a predetermined value, and the tightening force at the cut-off time is outputted and displayed. Therefore, even if impact operation is executed prior to the contact of the bearing surface, for example, even in case that a self-locking nut is applied to the tightening, the tightening force is accurately calculated by means of a rapid and brief calculation and control logic, and the dispersion of the tightening force at the cut-off time is decreased. In addition, it is possible to monitor the change of the tightening force during the tightening operation.

Figure 9:
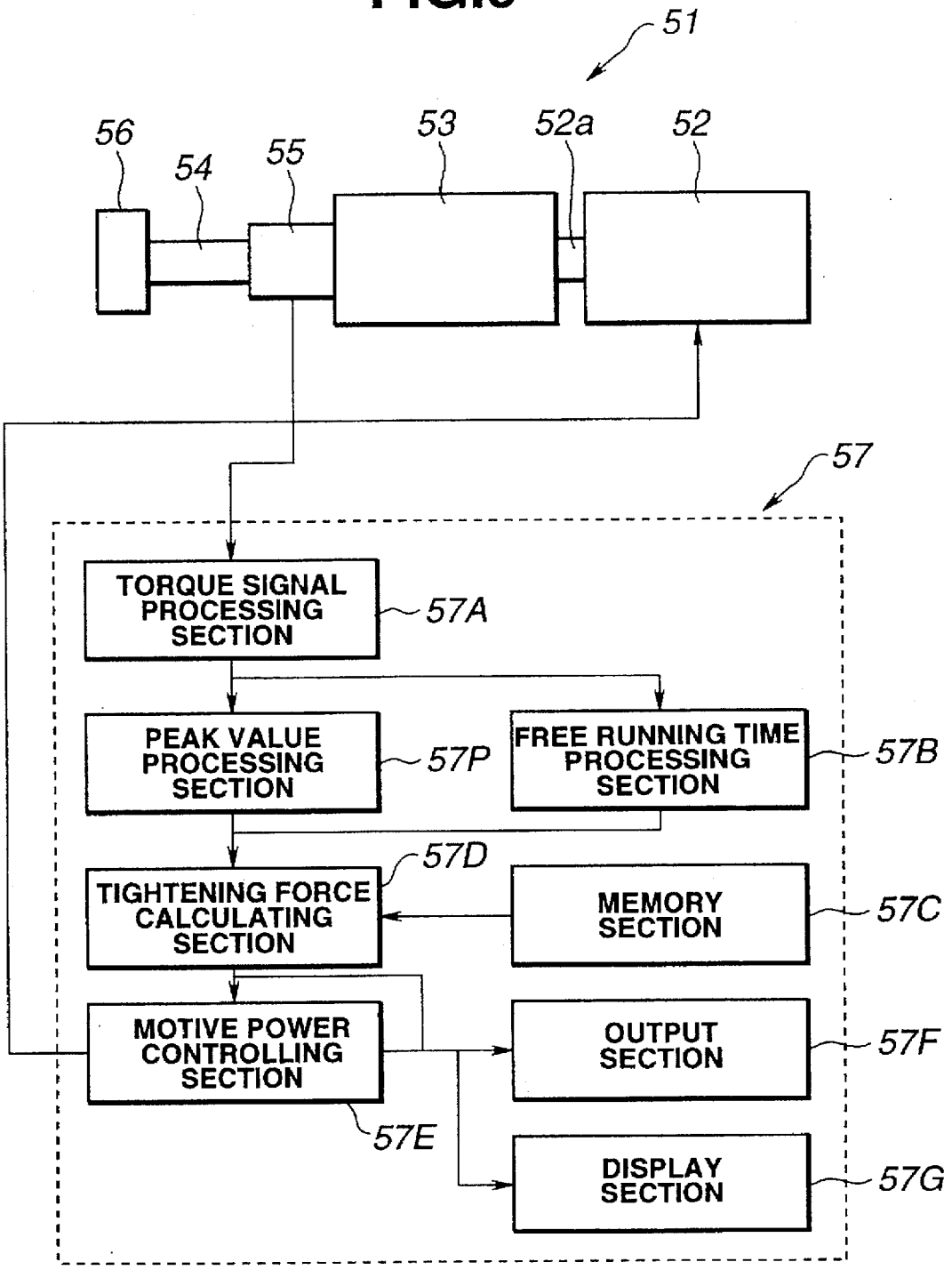
FIG. 9 is a block diagram which shows a third embodiment of the impact screw tightening apparatus according to the present invention.
Figure 10:
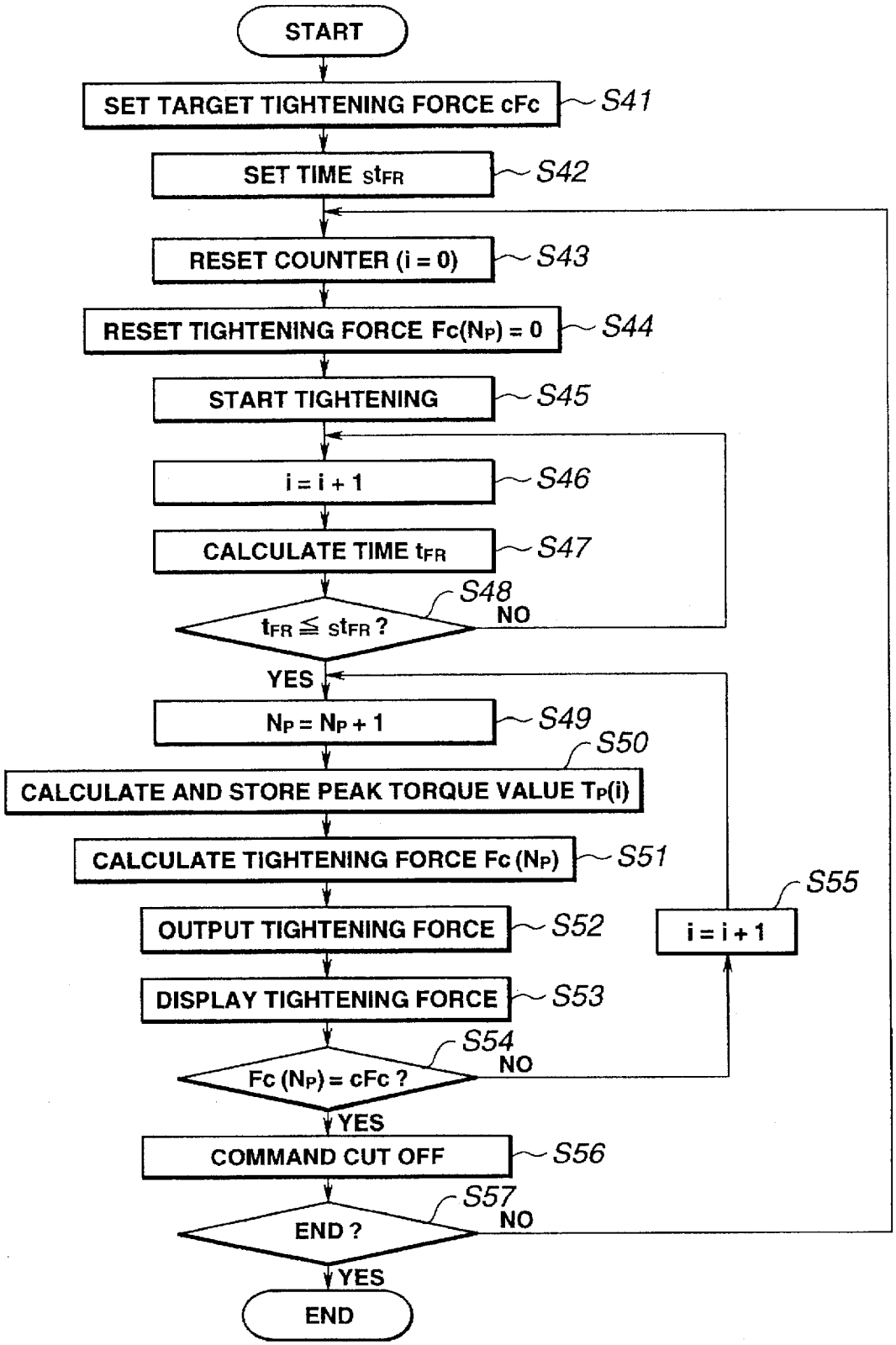
FIG. 10 is a flowchart which shows calculating operations in the third embodiment.
Figure 11:
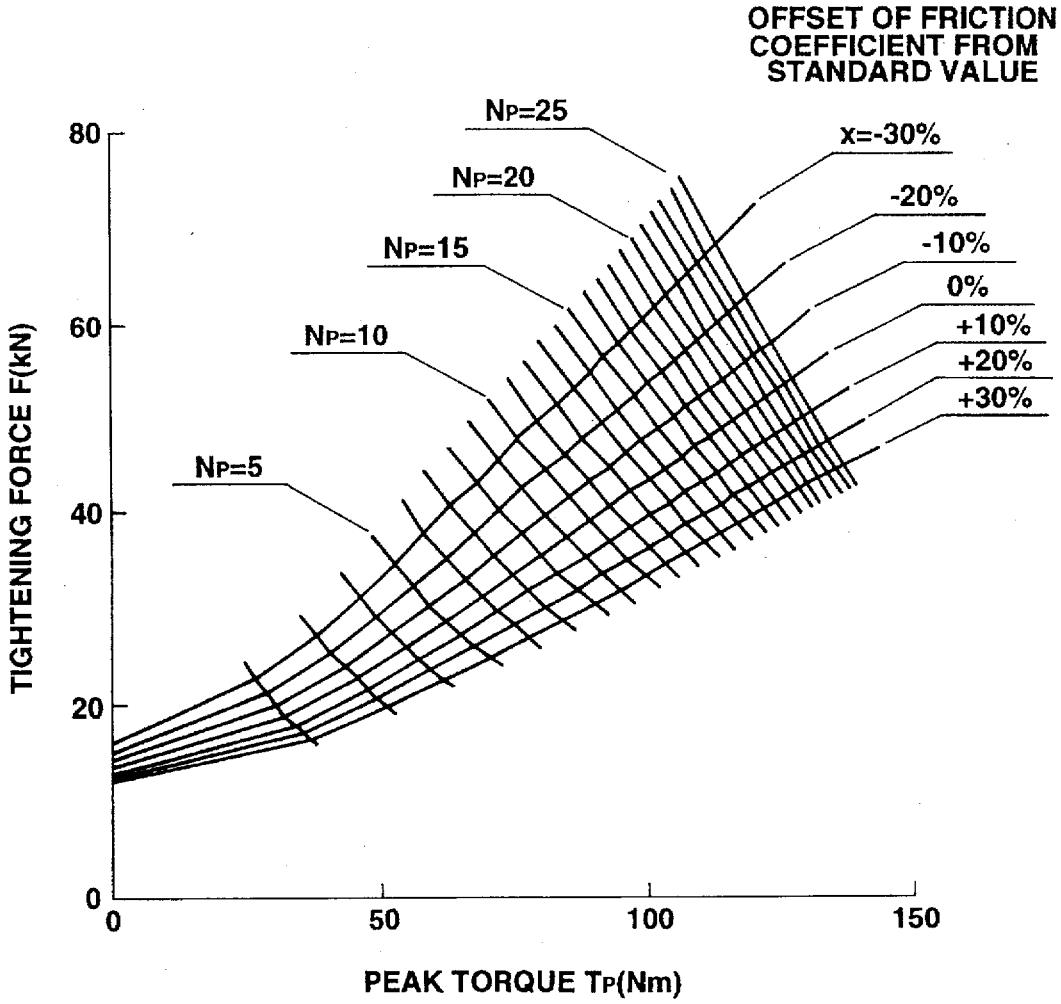
FIG. 11 is a graph which shows a relationship among the tightening force and the impact frequency generated after the contact of the bearing surface and a peak torque by each impact.

Referring to FIGS. 9 to 11, there is shown a third embodiment of the impact type screw-tightening apparatus according to the present invention. The third embodiment is arranged to detect the frequency of impacts and a peak torque value after the decision that the bearing surface of the bolt and nut is in contact with the tightened object, to calculate a tightening force at each impact on the basis of the previously obtained relationship between the tightening force, the frequency of the impacts generated after the contact of the bearing surface and the peak torque value by each impact, to output and display the tightening force at the cut off time, and to promptly cut off the power source of the drive means at a time that the tightening force becomes within a predetermined range.

As shown in FIG. 9, a main body 51 of the impact screw tightening apparatus of the third embodiment is constituted by a motor 52, an impact torque generator 53, a main shaft 54, a torque detector 55 and a tightening socket 56, as is similar to that of the first embodiment.

The main body 51 of the impact screw-tightening apparatus is connected with a controller 57. The controller 57 is constituted by a peak value processing section 57P; a torque signal processing section 57A, a free running time processing section 57B, an output section 57F and a display section 57G which are similar to those of the first embodiment; and a tightening force data storing section (memory section) 57C, a tightening force calculating section 57D and a motive power controlling section 57E which are slightly different from those of the first embodiment and the second embodiment. The peak value processing section 57P obtains a peak torque value by each impact according to the signal from the torque detector 55.

FIG. 11 shows an example of a table of a relationship between the impact frequency $N_p$, the peak torque value $T_p$ by each impact and the tightening force F. The concrete values of the relationship are various changed according to the combination of a bolt, a tightened object and the impact wrench. Therefore, this type of table is prepared for each of the combinations. The tightening force calculating section 57D calculates tightening force on the basis of this table.

Next, the operation of the third embodiment will be discussed with reference to the flowchart of FIG. 10.

At a step S41, the controller 57 sets a target tightening force $_{C}F_{C}$.

At a step S42, the controller 57 sets a free running time $_{S}t_{FR}$ corresponding to a threshold value for deciding that the bearing surface of the bolt and nut is contacted with the tightened object. At a step S43, a counter for counting the frequency i of impacts is reset (i=0).

At a step S44, the tightening force $F_C(N_P)$ is reset ($F_C(N_p)$=0).

At a step S45, the screw (bolt) tightening is started.

In the steps S46 to S57, the execution at a step S47 corresponds to the processing in the free running time processing section 57B, the execution at a step S50 corresponds to the processing in the peak value processing section 57P, the execution at steps S54 and S56 correspond to processing in the motive power controlling section 57E, and the other steps, that is, the steps S46, S48, S49, S51, S52 and S53 correspond to the processing at the tightening force calculating section 57D.

In a loop from a step S46 to a step S48, it is decided by each impact as to whether the bearing surface of the bolt is in contact with the tightened object or not until the bearing surface becomes in contact with the tightened object. At the step S46, the frequency (counter content) i of impacts is incremented by 1 (i=i+1). At a step S47, the free running time $t_{FR}$ is obtained on the basis of the signal from the torque signal processing section 57A.

At a step S48, it is decided as to whether or not the free running time $t_{FR}$ is smaller than or equal to the free running time threshold $_{S}t_{FR}$. When the decision at the step S48 is NO, the routine returns to the step S46. When the decision at the step S48 is YES, the routine proceeds to a next loop from a step S49 to S54 wherein the calculation of the tightening force $F_C(N_P)$ and the output and display of the calculated tightening force are executed by each impact.

At the step S49, the frequency $N_P$ of the impact generated after the contact of the bearing surface is incremented by 1 ($N_P$=$N_P$+1).

At a step S50, the peak torque value $T_P(i)$ by each impact is obtained and stored.

At a step S51, the tightening force $F_C(N_P)$ is calculated on the basis of the table stored in the tightening force data storing section 57C.

At a step S52, the controller 57 executes to output the calculated tightening force. At a step S53, the controller 57 executes to display the calculated tightening force. With this executions, the tightening force is outputted from the output section 57F and displayed at the display section 57G.

At a step S54, the controller 57 decides as to whether the tightening force $F_C(N_P)$ is larger than or equal to the target tightening force $_{C}F_C$ or not. When the decision at the step S54 is NO, the routine proceeds to a step S55 wherein the frequency i of the impacts is incremented by 1 (i=i+1). Following this, the routine returns to the step S49 and repeats the loop from the step S49 to the step S54. When the decision at the step S54 is YES, the routine proceeds to the step S56 wherein the controller 57 outputs a command for cutting off the cut off valve to stop the supply of the compressed air to the impact screw-tightening apparatus.

At a step S57, the controller 57 decides as to whether the routine is ended or not. When the decision at the step S57 is YES, the routine goes to END. When the decision at the step S57 is NO, the routine returns to the step S43 to execute next screw-tightening operation.

Figure 12:
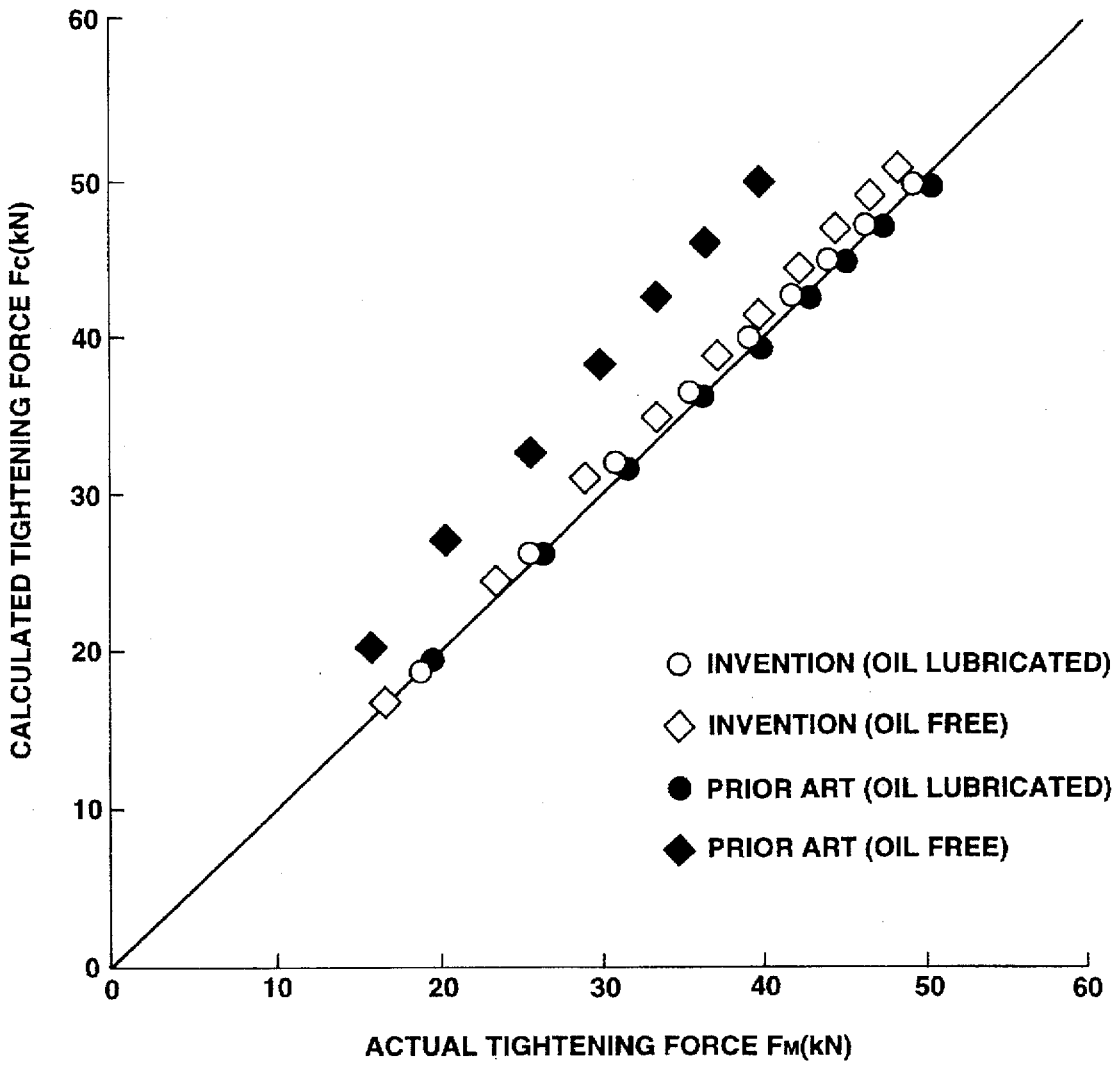
FIG. 12 is a graph which shows characteristics of the calculated tightening force with respect to the measured tightening force in the third embodiment.

FIG. 12 shows a comparison view where the calculated tightening forces of this invention and the conventional art are compared with actually measured tightening forces. In FIG. 12, white marks (◇, ○) denote the characteristics of the present invention, and black marks (●,◆) denote the characteristic of the conventional art. Further, ◇ mark and ◆ mark denote the characteristics in case that oil is used as lubricant, and ○ mark ● mark denote the characteristics in case that the lubricant is not used. This data was obtained as to a case that a tightened object having 40 mm distance between bearing surfaces was tightened at 50 kN by means of the bolt and nut of M12 size. The calculated tightening force F(i) of the present invention was obtained on the basis of the table of FIG. 11 (a table as to a relationship between the frequency Np of impacts generated after the contact of the bearing surface, the peak torque value $T_P$ by each impact and the tightening force F). On the other hand, the calculated tightening force of the conventional art was obtained on the basis of a table which shows a reliability of the torque-tightening force conversion coefficient $C_{TF}$ to tightening force.

As is clear from FIG. 12, in case of oil lubrication, the measuring accuracy of the present invention is generally similar to that of the conventional art because the conventional art using a table indicative of the reliability of the torque-tightening force conversion coefficient $C_{TF}$ to the tightening force F. On the other hand, in case of no lubrication, the measuring accuracy of the present invention is kept good although the measuring accuracy of the conventional art is largely degraded.

With the thus arranged third embodiment according to the present invention, the frequency of impacts is detected after the decision that the bearing surface of the bolt or screw is in contact with the tightened object according to the detection result of torque detecting means, and the tightening force by each impact is calculated on the basis of the previously obtained relationship between the tightening force and the frequency of the impacts generated after the contact of bearing surface and the peak torque value by each impact. Then, the tightening force is outputted and displayed, and the power source of the drive means is cut off at a time that the tightening force becomes within a predetermined range. Therefore, even if impact operation is executed prior to the head contact, for example, in case that a self-locking nut is applied to the tightening, the tightening force is accurately calculated by means of a rapid and brief calculation and control logic. In addition, the dispersion of the tightening force at the cut-off time is decreased. In addition, it is possible to monitor the change of the tightening force during the tightening operation, and it is possible to monitor the change of the tightening force according to the proceeding of the tightening operation.

Figure 13:
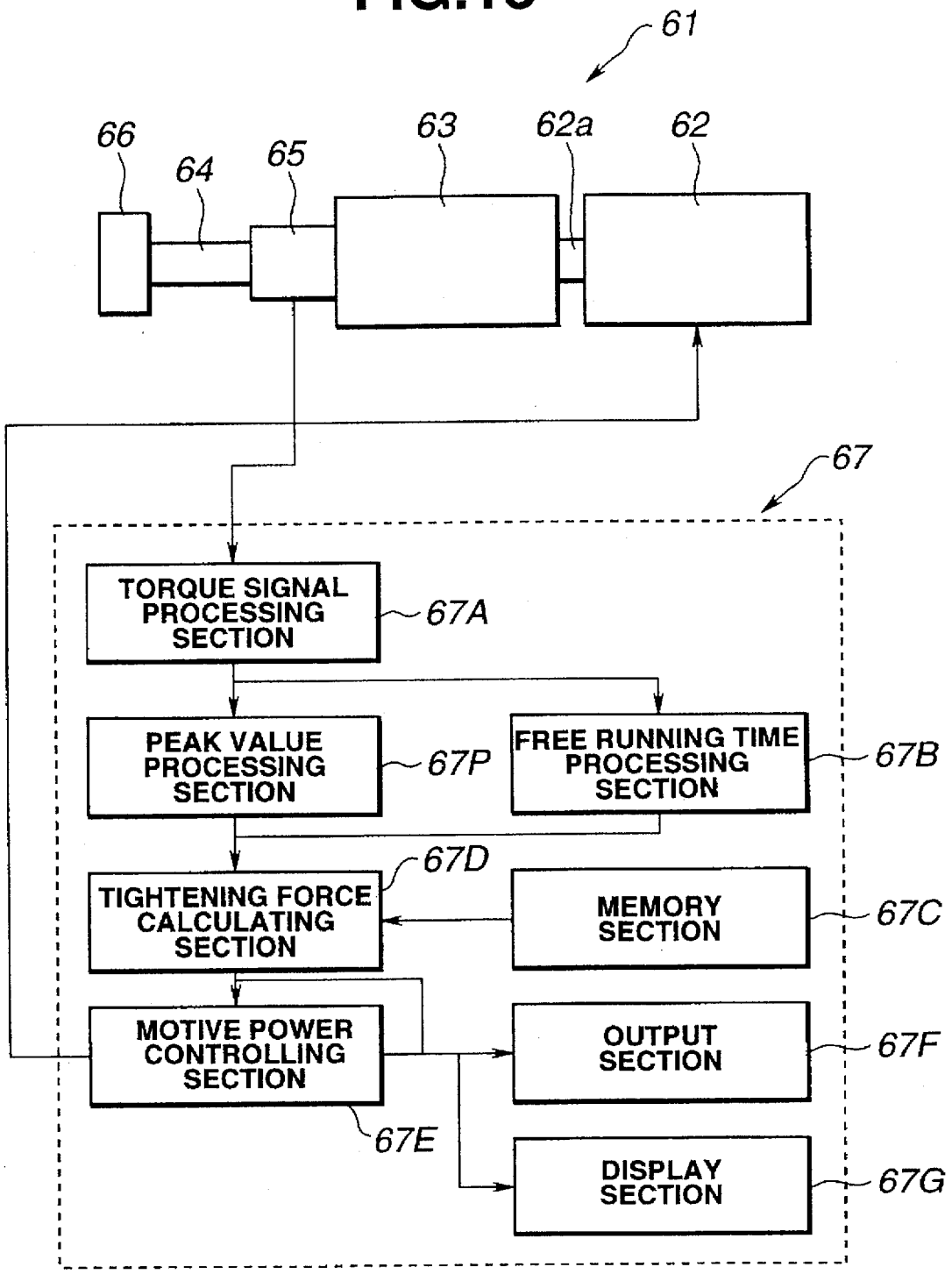
FIG. 13 is a block diagram which shows a fourth embodiment of the impact screw tightening apparatus according to the present invention.
Figure 14:
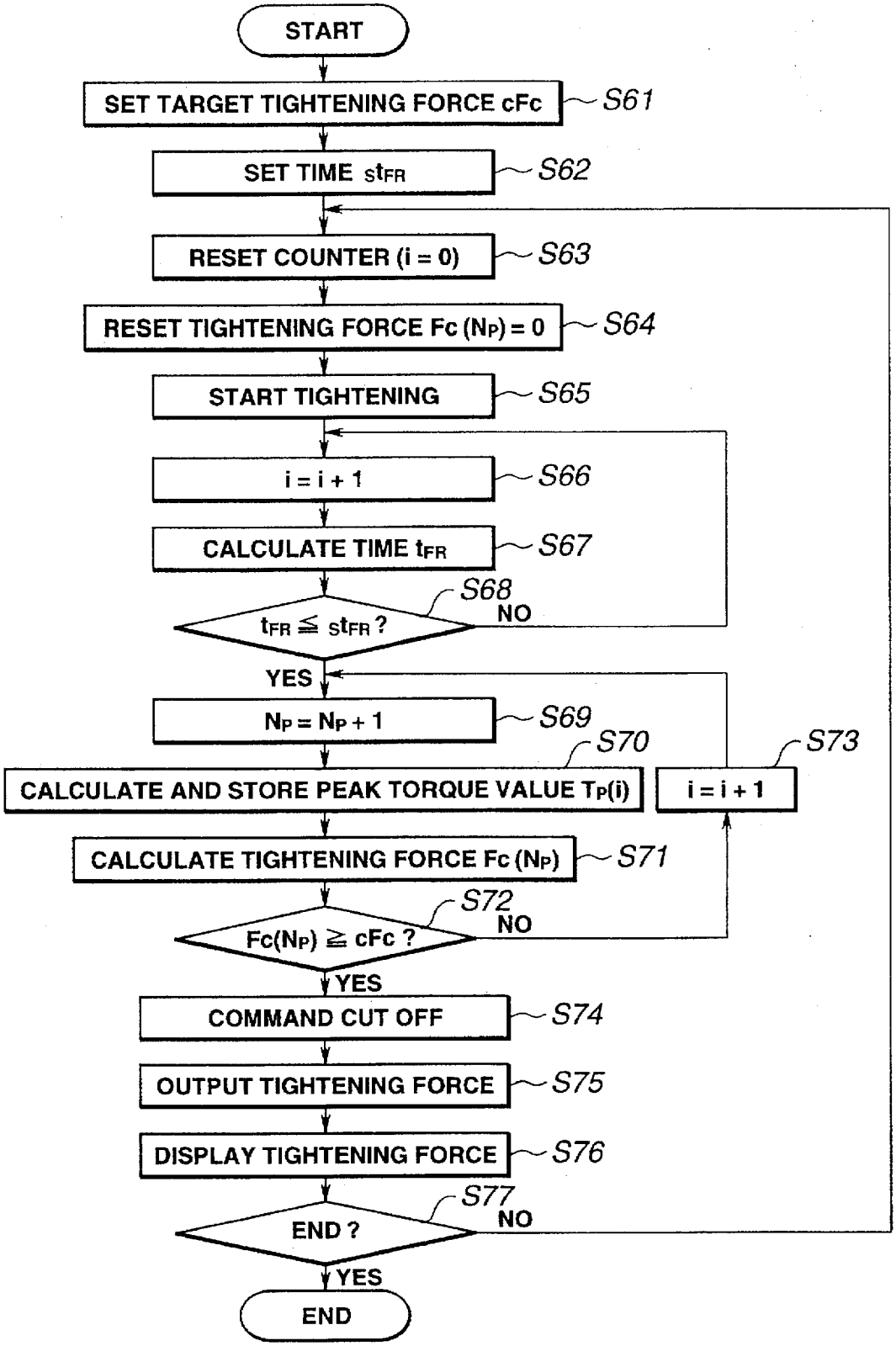
FIG. 14 is a flowchart which shows calculating operations in the fourth embodiment.

Referring to FIGS. 13 to 14, there is shown a fourth embodiment of the impact type screw-tightening apparatus according to the present invention. The fourth embodiment is arranged to detect frequency of impacts and a peak torque value after the decision that the bearing surface of the bolt or screw is in contact with a tightened object, to calculate tightening force at each impact on the basis of the previously obtained relationship between the tightening force and the frequency of the impact generated after the contact of the bearing surface and the peak torque value by each impact, further to promptly cut off the power source of the drive means at a time that the tightening force becomes within a predetermined range value, and to output and display the tightening force at the cut off time.

As shown in FIG. 13, a main body 61 of the impact screw tightening apparatus is constituted by a motor 62, an impact torque generator 63, a main shaft 64, a torque detector 65 and a tightening socket 66, as is similar to the first embodiment.

The main body 61 of the impact screw tightening apparatus is connected with a controller 67. The controller 67 is constituted by a torque signal processing section 67A and a free running time processing section 67B which are similar to those of the first embodiment; an output section 67F and a display section 67G which is similar to those of the second embodiment; a peak value processing section 67P, a tightening force data storing section (memory section) 67C and a motive power controlling section 67E which are similar to those of the third embodiment; and a tightening force calculating section 67D which are slightly different from that of the first, second and third embodiments.

The operation of the fourth embodiment will be discussed hereinafter with reference to the flowchart of FIG. 14.

At a step S61, the controller 57 sets a target tightening force $_{C}F_C$.

At a step S62, the controller 57 sets a free running time threshold $_{S}t_{FR}$ corresponding to a threshold value for deciding that the bearing surface of the bolt and nut is in contact with a tightened object.

At a step S63, a counter for counting the frequency i of impacts is reset (i=0).

At a step S64, the tightening force $F_C(N_P)$ is reset ($F_C(N_p)=0$).

At a step S65, the screw (bolt) tightening is started.

In a routine from a step S66 to a step S77, the execution at a step S67 corresponds to the processing in the free running time processing section 67B, the execution at a step S70 corresponds to the processing in the peak value processing section 67P, the executions at steps S72 and S74 correspond to processing in the motive power controlling section 67E, and the execution at the other steps correspond to the processing in the tightening force calculating section 67D.

In a loop from a step S66 to a step S68, it is decided by each impact as to whether the bearing surface of the bolt is in contact with the tightened object or not until the bearing surface of the bolt becomes in contact with the tightened object. At the step S66, the frequency (counter content) i of impacts is incremented by 1 (i=i+1). At a step S67, the free running time $t_{FR}$ is obtained on the basis of the signal from the torque signal processing section 67A.

At a step S68, it is decided as to whether or not the free running time $t_{FR}$ is smaller than or equal to the free running time threshold $_St_{FR}$. When the decision at the step S68 is NO, the routine returned to the step S66. When the decision at the step S68 is YES, the routine proceeds to a next loop from a step S69 to S73 wherein the calculation of the tightening force is executed by each impact.

At the step S69, the impact generation times $N_P$ after the head contact is incremented by 1 ($N_p=N_p+1$).

At a step S70, the peak torque value $T_P(i)$ by each impact is obtained and stored.

At a step S71, the tightening force $F_C(N_P)$ is calculated on the basis of the table stored in the tightening force data storing section 67C.

At a step S72, the controller 67 decides as to whether the tightening force $F_C(N_P)$ is larger than or equal to the target tightening force $_CF_C$ or not. When the decision at the step S72 is NO, the routine proceeds to the step S73 wherein the times i of the impacts are incremented by 1 (i=i+1). Following this, the routine returns to the step S69 and repeats the loop from the step S69 to the step S72. When the decision at the step S72 is YES, the routine proceeds to the step S74 wherein the controller 67 outputs a command for cutting off the cut off valve to stop the supply of the compressed air to the impact screw-tightening apparatus.

At a step S75, the controller 67 executes to output the tightening force. At a step S76, the controller 67 executes to display the tightening force. With this executions, the tightening force is outputted from the output section 67F and displayed at the display section 67G.

At a step S77, the controller 67 decides as to whether the routine is ended or not. When the decision at the step S77 is YES, the routine goes to END. When the decision at the step S77 is NO, the routine returns to the step S63 to execute next screw-tightening operation.

The fourth embodiment performed to ensure the result as same as that of the third embodiment shown in FIG. 12.

With the thus arranged fourth embodiment according to the present invention, the frequency of impacts is detected after the decision that the bearing surface of the bolt and nut is in contact with the tightened object according the detection result of torque detecting means, and the tightening force at each impact is calculated on the basis of the previously obtained relationship between the tightening force and the frequency of the impact generated after the contact of the bearing surface of the bolt or screw with the tightened object and the peak torque value by each impact. Then, the power source of the drive means is cut off at a time that the tightening force becomes within a predetermined range, and the tightening force is outputted and displayed. Therefore, even if impact operation is executed prior to the contact of the bearing surface, for example, even in case that a self-locking nut is applied to the tightening, the tightening force is accurately calculated by means of a relatively brief calculation and control logic. In addition, the dispersion of the tightening force at the cut-off time is decreased. Furthermore, it is possible to record and store the tightening force at the cut off time, and it is possible for an operator to monitor the tightening force during the tightening operation.

While the invention has been particularly shown and described with reference to preferred embodiments thereof, it will be understood by those skilled in the art that the foregoing and other changes in form and details can be made therein without departing from the sprit and scope of the invention.

What is claimed is:

1. An impact screw-tightening apparatus comprising:

a main body including a drive means outputting pulsed drive output, a main shaft driven by the drive means and connected to a screw to be tightened, and a torque detecting means detecting a change of torque applied to the main shaft;

a calculating means obtaining frequency of impacts generated from a time that a bearing surface of the screw is in contact with a tightened object, on the basis of the signal from the torque detecting means; and a control means cutting off a motive power source of the drive means at a time that the frequency of the impacts becomes a predetermined value.

2. An impact screw-tightening apparatus as claimed in claim 1, wherein said calculating means calculating tightening force by each impact on the basis of a relationship between tightening force and the frequency of the impacts generated after the bearing surface of the screw is in contact with the tightened object.

3. An impact screw-tightening apparatus as claimed in claim 2, further comprising a tightening force outputting means which outputs the tightening force by each impact.

4. An impact screw-tightening apparatus as claimed in claim 2, further comprising a tightening force displaying means which displays the tightening force by each impact.

5. An impact screw-tightening apparatus as claimed in claim 2, further comprising a tightening force outputting means which outputs the tightening force when the frequency of the impacts becomes a predetermined value.

6. An impact screw-tightening apparatus as claimed in claim 2, further comprising a tightening force displaying means which displays the tightening force when the frequency of the impacts becomes a predetermined value.

7. An impact screw-tightening apparatus as claimed in claim 1, wherein said calculating means decides that the bearing surface of the screw is in contact with the tightened object according to a signal from the torque detecting means.

8. An impact screw-tightening apparatus comprising:

a main body including a drive means outputting pulsed drive output, a main shaft driven by the drive means and connected to a screw to be tightened, and a torque detecting means detecting a change of torque applied to the main shaft;

a calculating means obtaining a frequency of impacts generated from a time that a bearing surface of the screw is in contact with a tightened object and a peak torque by each impact on the basis of a signal of the torque detecting means, said calculating means calculating tightening force by each impact on the basis of a relationship between the tightening force and the peak torque by each impact and the frequency of the impacts generated after the bearing surface of the screw is in contact with the tightened object; and a control means cutting off a motive power source of the drive means at a time that the tightening force becomes within a predetermined range.

9. An impact screw-tightening apparatus as claimed in claim 8, wherein said calculating means decides that the bearing surface of the screw is in contact with the tightened object according to a signal from the torque detecting means.

10. An impact screw-tightening apparatus as claimed in claim 8, further comprising a tightening force outputting means which outputs the tightening force by each impact.

11. An impact screw-tightening apparatus as claimed in claim 8, further comprising a tightening force displaying means which displays the tightening force by each impact.

12. An impact screw-tightening apparatus as claimed in claim 8, further comprising a tightening force outputting means which outputs the tightening force when the tightening force becomes within a predetermined range.

13. An impact screw-tightening apparatus as claimed in claim 8, further comprising a tightening force displaying means which displays the tightening force when the tightening force becomes within a predetermined range.

14. An impact screw-tightening apparatus comprising:

a main body including a drive motor outputting pulsed drive output, a main shaft driven by the motor and connected to a screw to be tightened, and a torque detector detecting a change of torque applied to the main shaft; and a controller including a torque signal processing section which generates a torque signal indicative of a torque generated in the main shaft, a free running time processing section which determines a free running time threshold for deciding that a bearing surface of screw is in contact with a tightened object, a memory section storing a relationship between the tightening force and the frequency of the impacts generated after the bearing surface of the screw is in contact with the tightened object, a tightening force calculating section calculating tightening force by each impact on the basis of data from the memory section, and a motive power controlling section cutting off a motive power source of the drive means at a time that the tightening force becomes a predetermined value.

15. An impact screw-tightening apparatus as claimed in claim 14, further comprising a peak torque processing section which obtains a peak torque value generated in the main shaft by each impact according to the signal from the torque detector.

16. An impact screw-tightening apparatus as claimed in claim 15, wherein the memory section stores a table indicative of a relationship between the tightening force and the peak torque by each impact and the frequency of the impacts generated after the bearing surface of the screw is in contact with the tightened object, the controlling section cutting tiff a motive power source of the motor at a time that the tightening force becomes within a predetermined range.

* * * * *